US005273456A

United States Patent [19]

Muzslay

[11] Patent Number: 5,273,456

[45] Date of Patent: Dec. 28, 1993

[54] MATE SENSING CONNECTOR SYSTEM

[75] Inventor: Steven Z. Muzslay, Huntington Beach, Calif.

[73] Assignee: ITT Corporation, Secaucus, N.J.

[21] Appl. No.: 865,527

[22] Filed: Apr. 9, 1992

[51] Int. Cl.[5] ..... H01R 3/00

[52] U.S. Cl. ..... 439/489; 439/188; 439/595

[58] Field of Search ..... 439/188, 507, 513, 488, 439/489, 511, 490, 491, 637

[56] References Cited

U.S. PATENT DOCUMENTS

| | | | |
|---|---|---|---|
| 3,323,102 | 5/1967 | Minor | 339/258 |
| 3,627,929 | 12/1971 | Vlijmen | 439/188 |
| 3,627,929 | 12/1971 | Petrus et al. | 179/96 |
| 3,654,592 | 4/1972 | Primorac | 439/862 |
| 4,087,151 | 5/1978 | Robert et al. | 439/637 |
| 4,283,103 | 8/1981 | Forberg et al. | 339/59 |
| 4,544,220 | 10/1985 | Aiello et al. | 439/595 |
| 4,685,887 | 8/1987 | Hanning | 439/188 |
| 4,687,888 | 8/1987 | Hasircoglu | 200/51.1 |
| 4,850,888 | 7/1989 | Denlinger et al. | 439/188 |
| 4,904,196 | 2/1990 | Sueyoshi et al. | 439/188 |
| 4,978,311 | 12/1990 | Oda et al. | 439/188 |
| 4,998,896 | 3/1991 | Lundergan | 439/595 |
| 5,035,648 | 7/1991 | Kuiper-Moore | 439/595 |
| 5,044,991 | 9/1991 | Colleran et al. | 439/595 |
| 5,088,931 | 2/1992 | Niciolo et al. | 439/188 |
| 5,114,359 | 5/1992 | Chrishima et al. | 439/489 |

FOREIGN PATENT DOCUMENTS

| | | | |
|---|---|---|---|
| 6508627 | 1/1967 | Netherlands | 439/637 |

*Primary Examiner*—Gary F. Paumen
*Assistant Examiner*—Hien D. Vu
*Attorney, Agent, or Firm*—Thomas L. Peterson

[57] ABSTRACT

A connector system in described which senses connector mating by sensing the disengagement of two sensor contacts in a first of two connectors, which enables such sensing contacts to be readily installed and which minimizes connector complexity and size. The first connector (12, FIG. 3) has a pair of sensing contacts (20, 22) with deflectable front end portions (106) that are biased together to touch each other, with the front end portions being accessible from the front of the connector. A second mating connector (14) has a separator (24) at its front end that is positioned to wedge apart the front end portions of the sensing contacts as the connectors approach a fully mated position. Each sensing contact includes a rear mount portion (70, 72) which can mount in a seal-retainer portion (92) of the first connector housing, and each sensing contact also includes a beam (74, 76) with a free front end which (in its undeflected orientation 76*b*) extends substantially forwardly from the rear mount portion to enable the entire sensing contact to be readily inserted into place. A forward housing portion forms a pair of ramp deflectors (130, 132) which deflect each beam towards the other beam as the sensing contacts are pushed forwardly into place.

6 Claims, 5 Drawing Sheets

MATE SENSING CONNECTOR SYSTEM

BACKGROUND OF THE INVENTION

In some connector applications, it is important to detect when a pair of connectors have been substantially fully mated. For example, connectors that connect to automobile anti-locking brakes may require means for indicating full mating, to a computer that monitors functions of various parts of the automobile. "Standard" connector types have been used which include parts for sealing the contacts against moisture, retaining them in place, and assuring reliable locking of the connectors to each other, but which do not have means for sensing when the connectors are mated. It would be desirable if a connector which could sense mating could be constructed using primarily "standard" parts already developed for similar connectors, to minimize design and tooling as well as to minimized the size of the connectors. Such mate sensing means should be as simple and low cost as possible, and readily installable in place of pin or socket contacts.

Various connector mate sensing devices have been proposed. One such device, described in U.S. Pat. No. 4,687,888 by Hasircoglu, employs a pair of contacts mounted in a first connector and having beams biased into engagement with each other. A separator is slidably mounted on the same first connector but is spring biased away from the contact beams. When the first connector mates with a second one, a protruding forward portion of the separator is deflected rearwardly and a wedge on the separator is pushed between the contact beams to separate them. Such a mechanism requires guides for slidably supporting the separator and a spring for biasing the separator forwardly, all of which increases the complexity, size, and cost of the connector. Furthermore, available connectors cannot be readily adapted to accommodate a spring and to slidably mount a separator, so that a connector with such mate sensing means would require considerable new design and tooling. A connector with mate sensing means of very simple construction, and which could be readily installed in the place of common socket or pin contacts, so as to require only limited retooling of the mating connectors and avoid increasing their sizes, would be of considerable value.

SUMMARY OF THE INVENTION

In accordance with one embodiment of the present invention, means are provided on a first connector for sensing when the first connector mates with a second one, which is of simple and low profile construction and which facilitates installation of the sensing means in most of the parts of available connectors. The sensing means include a pair of sensing contacts mounted in the first connector and having deflectable front end portions that are biased together to touch each other, with the front end portions being accessible from the front of the first connector. The second connector has a separator at its front end that is positioned to enter between the front end portions of the sensing contacts and separate them when the connectors are mated.

The first connector has a housing with a seal-retain portion which seals and retains the sensing contact rear portions (and wires connected thereto). Each front portion of a sensing contact is in the form of a beam having a free end. The sensing contacts are constructed with the beams initially extending substantially forwardly to fit within the profile of the rear sensing contact portions, to enable the beams to be readily inserted through holes in the seal-retain portions of the housing. A forward portion of the housing has a deflector forming a ramp that bends the beam towards the beam of the other sensing contact as the sensing contact is installed. In this way, holes of prior art seal-retain portions of the housing, which otherwise receive simple pin or socket contacts, can be used to receive the sensing contacts.

The novel features of the invention are set forth with particularity in the appended claims. The invention will be best understood from the following description when read in conjunction with the accompanying drawings.

DESCRIPTION OF THE PREFERRED EMBODIMENT

Figure 1:
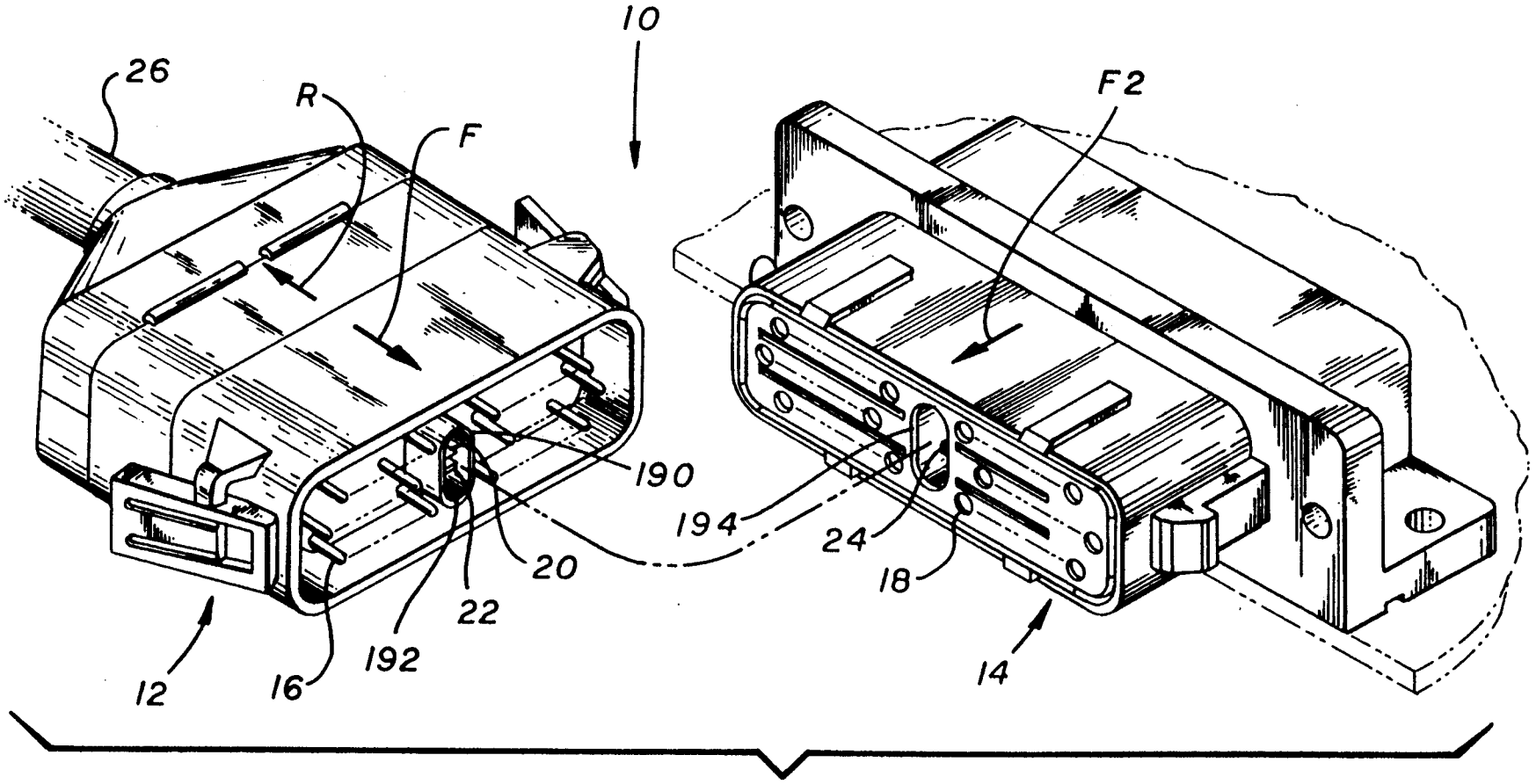
FIG. 1 is an isometric view of a connector system constructed in accordance with the present invention, with the connectors unmated from each other.

FIG. 1 illustrates a connector system 10 which includes first and second connectors 12, 14 that mate by moving them in forward directions indicated by arrows F and $F_2$ toward each other, and which can unmate by moving connector 12 in the direction R. Connector 12 has pin contacts 16 arranged in three rows, while connector 14 has corresponding socket contacts 18. The first connector 12 also has a pair of mate sensing contacts 20, 22 that engage each other when the connectors are not mated. The second connector or connector device 14 includes a separator 24 which moves between the ends of the mate sensing contacts 20, 22 to separate them when the connectors are mated. This allows circuitry connected to the two sensing contacts 20, 22 through wires of a cable 26, to determine when the connectors have been substantially fully mated. The particular connectors shown are used in vehicles to connect a computer to antilocking brakes, the computer energizing an alarm light when the connectors are not mated.

Figure 2:
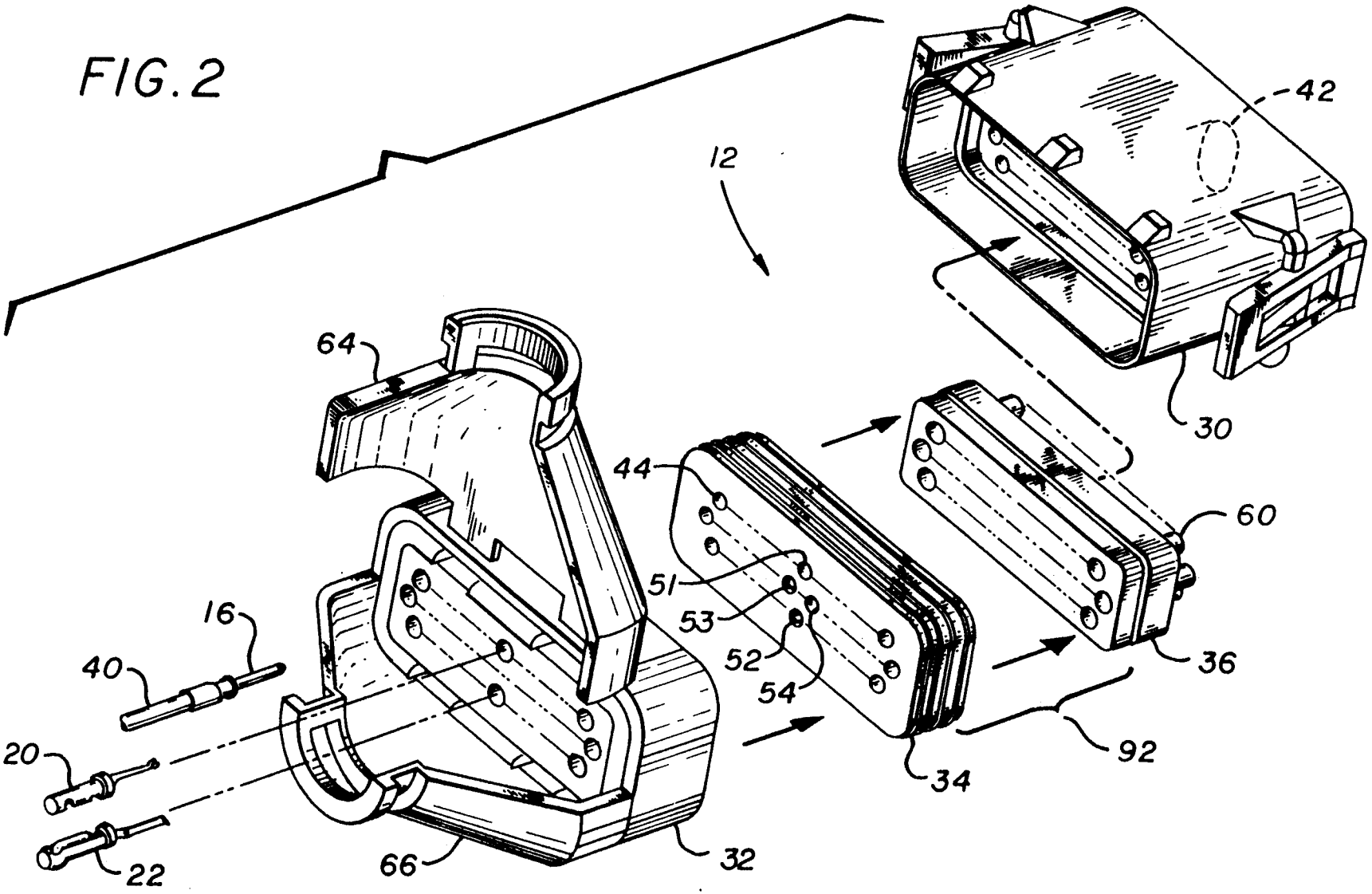
FIG. 2 is an exploded isometric view of a first connector of the system of FIG. 1.

FIG. 2 illustrates parts of the first connector 12, which includes front and rear housing parts 30, 32 and a seal 34 and retainer 36 which are trapped between the front and rear parts. One of the pin contacts 16 is shown, with a wire 40 trailing behind it. The figure also shows the first and second sensor contacts 20, 22, but without the wires connected thereto. Except for a front portion 42 of the front housing part 30, the entire connector housing, including parts 30–36, is known in the prior art. Each of the parts such as the grommet or seal 34 has three rows of holes 44 which can each receive a pin contact. With the sensing contacts 20, 22 being used, the sensing contacts are designed to fit through holes 51, 52 at the center of the top and bottom rows, while holes 53, 54 at the middle of the center row are unused. Thus, in the connector of FIG. 2 which can otherwise hold up to twenty-eight pin contacts, the sensing contacts 20, 22 prevent use of four holes, and the connector can hold up to twenty-four pin contacts as well as the two sensor contacts. It may be noted that the grommet or seal 34 is constructed of soft rubber to seal out moisture, while the retainer 36 is formed of a harder plastic and includes four fingers or tines 60 around each contact holding hole in the retainer to retain a contact in place.

Figure 3:
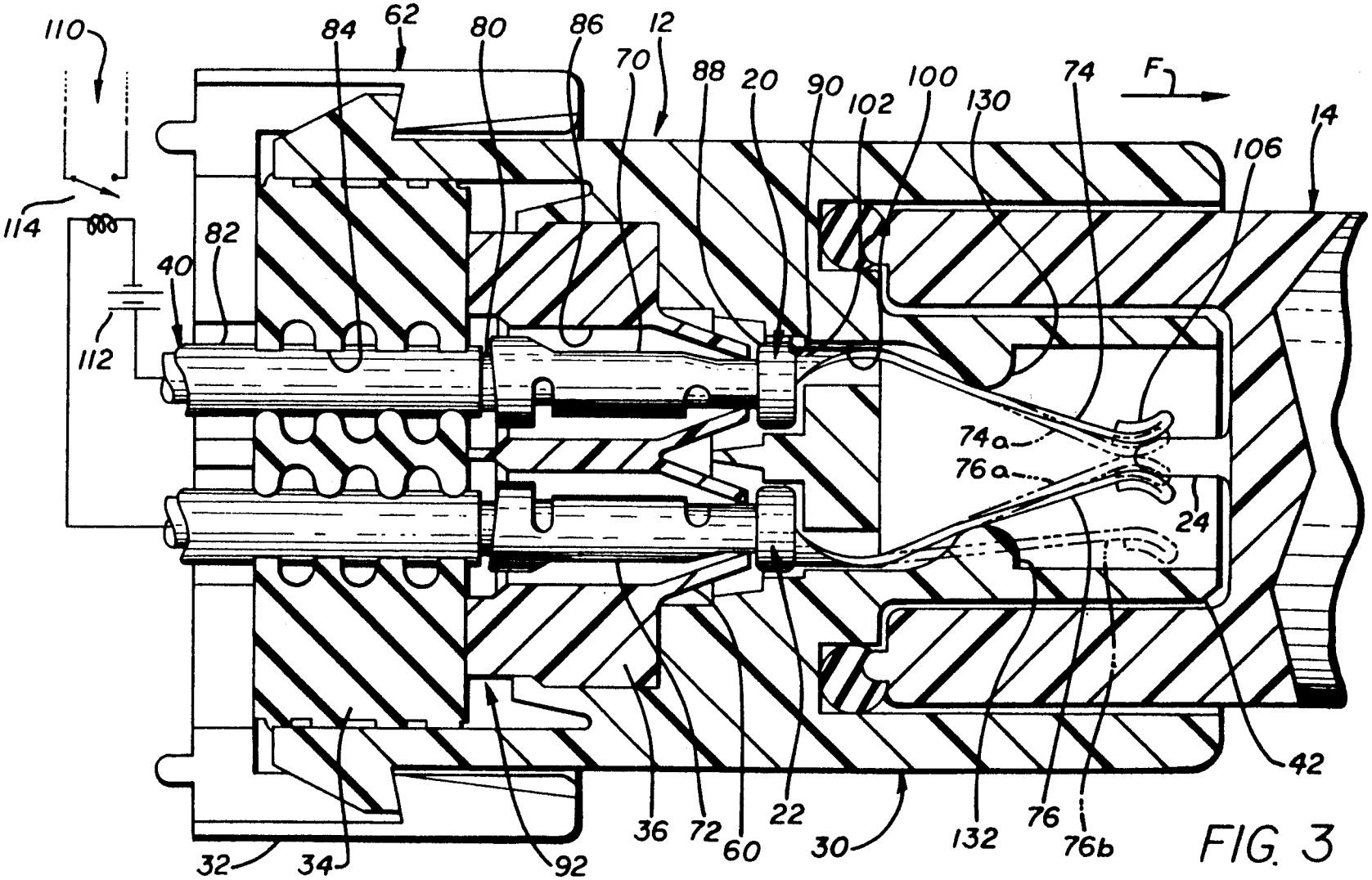
FIG. 3 is a sectional view of the connector system of FIG. 1, with the connectors show in their fully mated positions, and also showing in phantom lines the sensing contacts in their installed but unmated positions, and also showing in phantom lines the position that would be assumed by a sensing contact in the absence of a deflector.

FIG. 3 shows, in solid lines, the two sensing contacts 20, 22 fully installed in the connector housing 62 which includes the four parts 30–36. It may be noted that a pair of backshells which are shown in FIG. 2 at 64, 66 and which are hinged on the rear housing part 32, are not shown in FIGS. 3 and 4.

Each sensing contact 20, 22 includes a rear mount portion 70, 72 and a beam 74, 76 projecting generally forwardly in the direction F from the rear mount portion. Each rear mount portion such as 70 is crimped to the central conductor 80 of a wire 40 whose insulation 82 lies snugly within an aperture 84 of the seal 34. The seal 34 is constructed of soft rubber to provide a moisture seal. The retainer 36 has four tines 60 around each of its apertures 86, which retain a sensing contact by abutting a shoulder 88 formed at the front of the rear mount portion 70. The front housing part 30 has an aperture 90 that receives an enlarged part of the rear mount portion that forms the shoulder 88. The front portion 42 of the front housing part, which is the portion lying forward of the seal and/or retainer portion 92 (formed by the seal 34 and retainer 36) has a beam-passing hole 100 which passes the rear end or rear portion 102 of the beam. The forward ends or portions 106 of the two beams 74, 76 lie in a bent or deflected position wherein they tend to engage each other. It may be noted that FIG. 3 shows the rear mount portion 70, 72 of each contact lying only in the retain portion 36 of the seal-retain portion 92 of the housing.

When the connectors are unmated, the beams 74, 76 lie in the positions **74*a*, 76*a* wherein their forward ends 106 touch each other. When the connectors are fully mated, the separator 24 deflects the forward ends 106 apart to separate them, so that current cannot pass from one sensing contact 20 to the other 22. A circuit 110 senses when the sensing contacts engage each other or are out of contact with each other. The particular circuit 110 shown is a simplified circuit, which includes a source 112 of current, which can flow between the contacts when they touch each other, and a relay 114** which is open when the connectors are unmated so the sensing contacts touch each other and allow current to flow between them.

Figure 4:
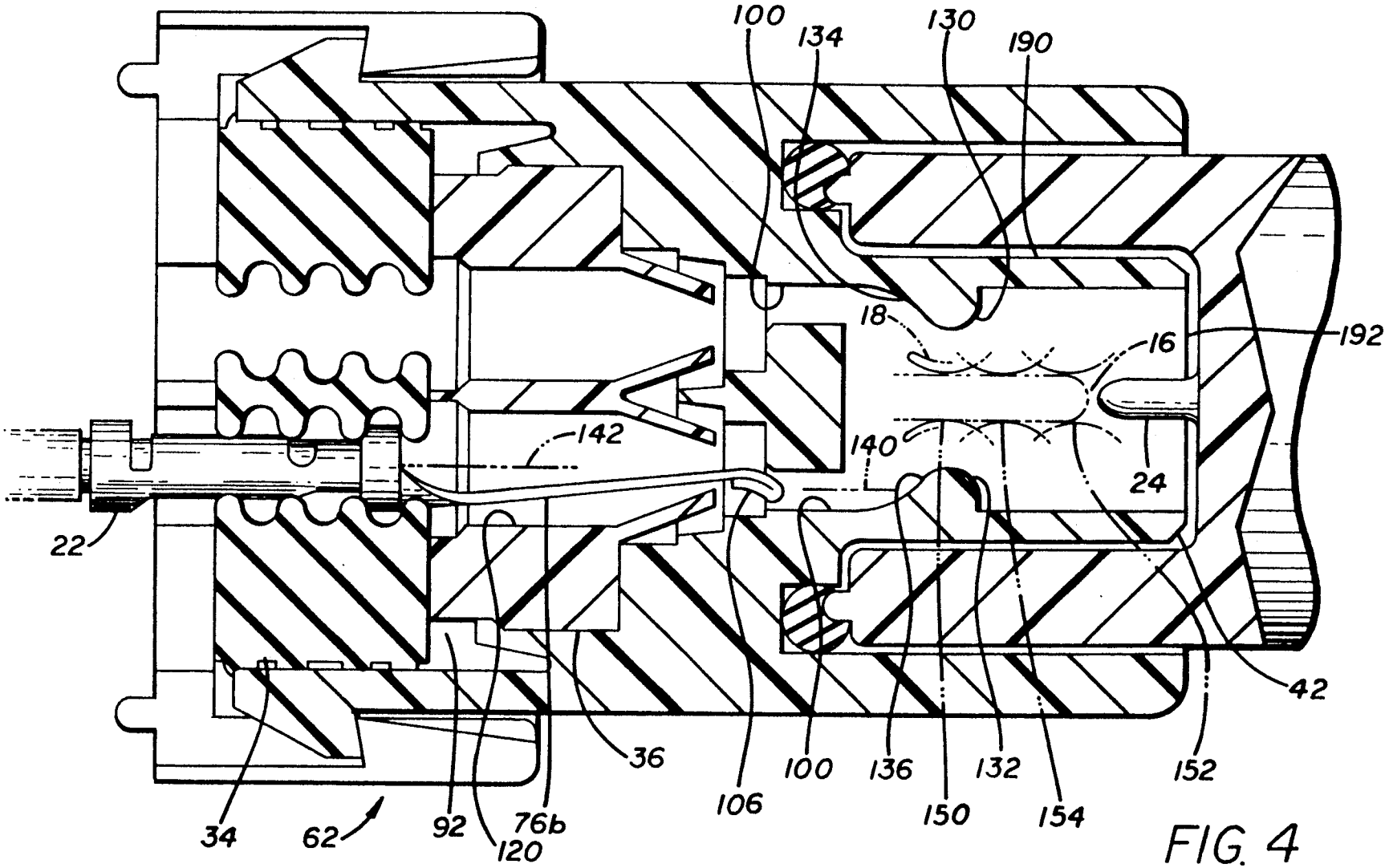
FIG. 4 is a sectional view similar to that of FIG. 3, but with one of the sensing contacts removed and with the other sensing contact shown in a partially installed position.

FIG. 4 shows one of the sensing contacts 22 during the course of its installation in the housing 62. In order for the beam at position **76*b* to pass through the hole 120 formed in the seal-retain portion 92 (which is formed by the seal 34 and retainer 36), it is highly desirable that the beam 76*b* extend substantially in the forward direction F wherein it lies substantially within a forward extension 72*x* (FIG. 5) of the rear mount portion 72 of the sensing contact. This allows the beam 76*b* to pass easily through the hole 120**.

In accordance with one aspect of the present invention, the front portion 42 of the housing is provided with a pair of deflectors 130, 132 that each forms a ramp 134, 136. Each ramp such as 136 has a surface which extends progressively closer to the other sensor contact at progressively more forward locations along the ramp surface. As the sensing contact 22 is pushed forwardly, its forward end 106 and then the rest of the beam rides up the ramp 136, which deflects the beam towards the other sensing contact beam. The result, shown in FIG. 3, is that the forward ends 106 of the two sensing contacts are deflected into engagement with each other. The presence of the ramp allows the sensing contacts to fit into forwardly-rearwardly extending holes 120 of limited width, in the same manner as the pin contacts are installed, and yet enables the beams at the front of the sensing contacts to extend towards each other to engage each other. As a result of this construction, all parts of the connector housing, except for the front portion 42 of the front housing part 30, can be identical to those of prior connectors. Even the front housing part can be identical to prior connectors except for a small region at the middle of its front portion, which allows only relatively small modification of tooling for injection molding of the front housing part.

The holes 100 in the front housing portion 42, which pass the sensing contact beams 74, 76 and finally surround their rear portions 102, are not centered on the holes 120 of the seal-retain portion of the housing. Instead, the axis 140 of the hole 100 is offset from the axis 142 of the hole 120. Such offsetting assures that each sensing contact 20, 22 will be installed in the proper orientation. The forward portion holes 100 are offset to lie further from the other sensing contact rather than closer to it. By lying further from the other sensing contact, applicant bends each beam 74, 76 at a greater angle A (e.g. 22°) from a straight forward direction, which makes separation of the beams by the separator more reliable.

In FIG. 4 applicant shows in phantom lines, one of the pin contacts 16 fully engaged or mated with a corresponding socket contact 18, with the two contacts touching each other at the location 150. As the connectors approach each other, the pins and sockets first engage each other at an initial mated position 152. At an engagement position 154 which is between the initial and fully mated positions 152, 150, the separator 24 will have been moved forwardly enough to first separate the forward ends 106 of the sensing contacts.

Figure 5:
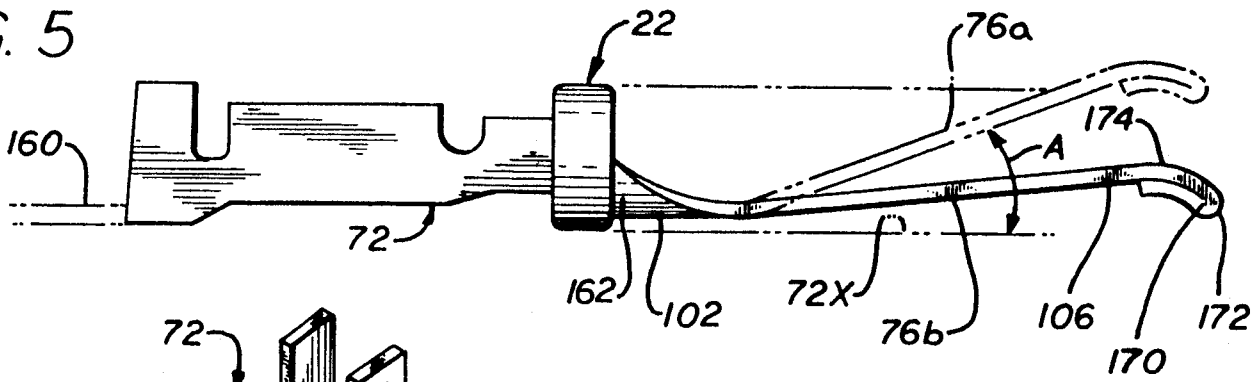
FIG. 5 is a side elevation view of one of the sensing contacts of FIG. 4.
Figure 7:
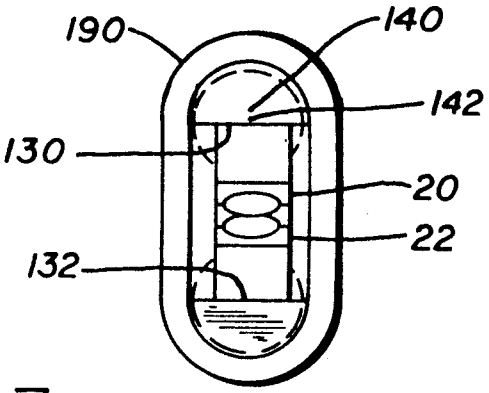
FIG. 7 is a front elevation view of a portion of the connector of FIG. 1.
Figure 6:
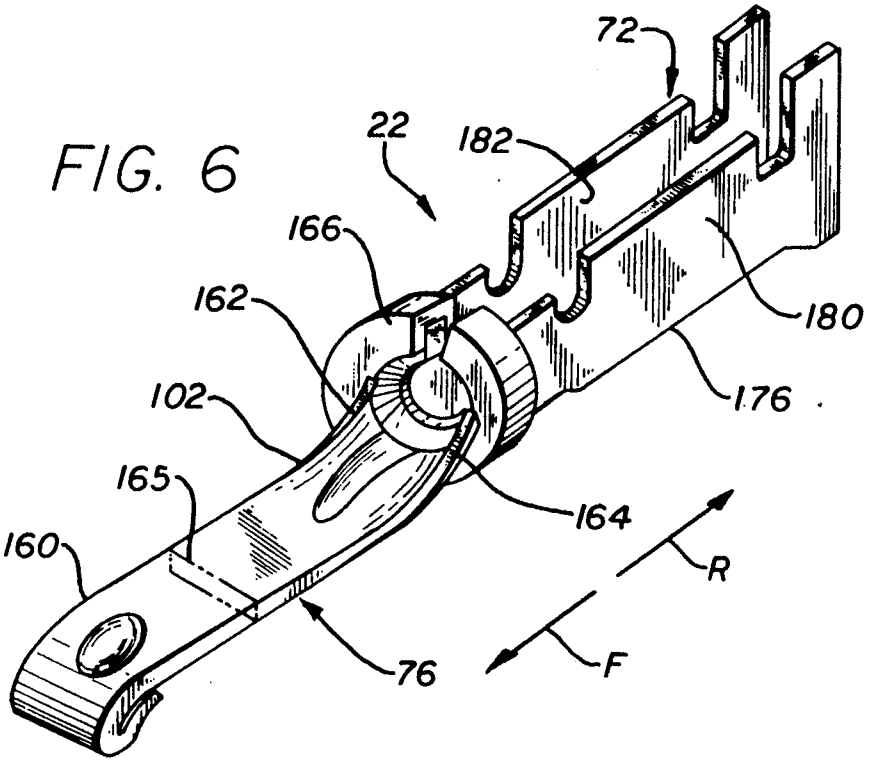
FIG. 6 is an isometric view of the sensing contact of FIG. 5.

FIGS. 5 and 6 illustrate some details of the sensing contact 22, which is formed from a piece of sheet metal and which can be initially connected to other similar sensing contacts by a carrier strip indicated at 160. The rear end or portion 102 of the beam forms a transition part, with largely vertical sides 162, 164 that are tapered in height to provide high strength along the transition from the largely rectangular section 165 of most of the beam, and the large diameter region that forms a forwardly-facing shoulder 166 at the front of the rear mount portion 72. The beam free front end 160 is bent approximately 180° around itself about an axis 170 extending perpendicular to the forward direction, to thereby form a rounded beam leading edge or tip 172, and to form a two layer part at the front end where there are two facewise adjacent and parallel layers. As shown, the separation of the two layers is less than the beam thickness. The front end also has a depression forming a protuberance 174 where it engages a corresponding protuberance on the beam of the other sensing contact. The mount rear portion 72 has a first or bottom side 176 which is bent into a largely 180° loop to form a bottom and spaced opposite sides 180, 182. The conductor of a stripped wire can lie within the sides 180, 182 and against the bottom 176, and the sides can be crimped around it (and/or soldered in place).

As shown in FIG. 1, applicant prefers to form the first connector 12 with a sensor shroud 190 around the beams of the two sensing contacts 20, 22, while leaving a region 192 forward, of the contacts open to provide access. Also, the second connector device 14 is provided with a separator shroud 194 that surrounds the separator and that fits around the sensor shroud 190 when the connectors mate.

Thus, the invention provides a connector system which enables sensing of the mating of a first connector with a second connector or connector device, which is of simple construction and with parts that can be installed in the same simple manner as simple pin or socket contacts, with only minor modification to the connector housings. The sensing means includes a pair of sensing contacts having rear mount portions mounted in a seal-retain portion of the housing, and having beams extending forwardly therefrom and bent so the forward ends or portions of the beams engage each other. The region forward of the front ends of the beams is open, so a separator on a second connector device wedges between the two beam end portions to separate them as the first connector and second connector device mate. The fact that the only sliding parts are the two connectors which slide together and apart to mate and unmate, eliminates the need to provide a track-guided sliding part and a separate biasing spring in the first connector. A forward housing portion of the first connector has a pair of ramps which deflect each beam towards the other beam as the sensor contacts are inserted into place. A sensor shroud lying around the forward end portions of the sensing contacts protects them, and can mate with a separator shroud portion lying around the separator on the second connector device. The front end of each sensing contact beam can be bent over to provide a rounded tip, and the rear portions of the beams can form a strengthened tapered transition portion.

Although particular embodiments of the invention have been described and illustrated herein, it is recognized that modifications and variations may readily occur to those skilled in the art, and consequently, it is intended that the claims be interpreted to cover such modifications and equivalents.

I claim:

1. A connector comprising:

a housing having a seal-retain portion forming a plurality of elongated contact-receiving holes extending in predetermined forward and rearward directions, including first and second sensor-contact receiving holes, said housing also having a forward portion lying forward of said seal-retain portion;

a pair of sensor contacts each having a rear mount portion lying in one of said sensor-contact receiving holes of said seal-retain portion, and each of said sensor contacts including a forward portion in the form of a beam with a front end, said beam tending to remain in an undeflected orientation wherein it extends substantially in said forward direction from its sensor contact rear mount portion;

said housing forward portion forming a pair of ramps with each ramp holding one of said beams in a deflected position, in which the beam extends to one side of an imaginary extension of the corresponding mount portion toward the other beam and engages the front end of the other beam, said ramps each having a surface extending progressively more forwardly and progressively closer to the other ramp to deflect a beam of a sensor contact as the contact is moved forwardly into said housing.

2. The connector described in claim 1, including:

a second connector device which has a front end that can mate and unmate from said connector;

of said connector and second connector device, one has a plurality of pin contacts and the other has a plurality of socket contacts that fully mate with said pin contacts when said connector and second connector device each moves forwardly toward the other and becomes fully inserted at a fully mated position of said connector and connector device, with all of said pin and corresponding socket contacts first touching one another at an initial mated position;

said housing forward portion is open immediately in front of said sensor contact front ends, and said second connector device includes a separator in the form of a wedge that is positioned to enter between said beam front ends and separate them when said connector and second connector device are between said initial and fully mated positions.

3. The connector described in claim 1 wherein:

each of said sensor contact rear mount portions has a greater width than the thickness of said beams and each rear mount portion has first and second sides;

said beam of each sensor contact has a rear beam portion extending from a first side of said sensor contact rear mount portion;

said housing forward portion forms a pair of forward portion holes that are each aligned with only that side of a corresponding seal-retain sensor-contact receiving hole, which is furthest from the other sensor-contact receiving hole, whereby to fix the orientation of said beams to undergo maximum deflection by said ramps.

4. A connector system which includes first and second connectors that are moveable forwardly to mate and rearwardly to unmate, one having pins at its front end and the other having sockets at its front end that receive the pins, characterized by:

a first of said connectors has a pair of mate sensing contacts with deflectable front end portions that are biased toward each other to engage each other when not separated, said front end portions being accessible from the front of said first connector;

a second of said connectors has a separator at its front end that is positioned to deflect said front end portions of said sensing contacts apart as said connectors mate;

each of said sensing contacts includes a rear portion which mounts securely in said first connector housing, and each of said sensing contacts includes a beam extending generally forwardly from said rear portion in the undeflected configuration of said beam, with each beam having a forward end for engaging the forward end of the other beam;

said first housing has a seal-retain portion which surrounds said sensing contact rear portions, with said seal-retain portion forming a plurality of holes extending in said forward direction, and said seal-retain portion is constructed to receive a corresponding one of said sensing contacts only by insertion of the sensing contact in a forward direction into one of said holes;

said first housing has a forward housing portion which lies forward of said seal-retain portion and which includes a pair of deflectors which are each positioned in line with a different one of said holes and which each forms a ramp that maintains a corresponding one of said beams in a deflected orientation with respect to its undeflected orientation to urge the beam forward ends to engage each other.

5. A method for detecting from a first connector that the front of said first connector and of a second connector are mated, characterized by:

establishing a pair of electrically conductive sensor contacts in said first connector, with each sensor contact having a beam with a free end and with said free ends pressing against each other, and with the space between said free ends open to the front of said first connector;

establishing a dielectric wedge-shaped separator on said second connector and moving said separator through the front of said first connector and between said beam free ends to separate them as said connectors mate;

electrically sensing the opening of a circuit which connects between said sensor contacts;

said first connector has a seal-and-retain portion with a plurality of rows of holes, and each of said sensor contacts includes a rear mount portion constructed to mount in one of said holes with each beam extending forwardly from the rear mount portion of the contact, and including;

mounting each sensor contact by projecting first the beam thereof and then the rear mount portion thereof, forwardly through one of said holes in said seal-retain portion, wherein the holes receiving said two sensor contacts lie adjacent to each other and have hole axes;

deflecting the beam of each of said sensor contacts toward the axis of the other hole that receives a sensor contact, as the rear mount portion of the contact becomes fully inserted into said seal-and-retain portion, so the beam free ends of the fully inserted sensor contacts touch each other.

6. A connector system which includes first and second connectors that are moveable forwardly to mate and rearwardly to unmate, characterized by:

a first of said connectors has a pair of mate sensing contacts with deflectable front end portions that are biased toward each other to engage each other when not separated, said front end portions being accessible from the front of said first connector;

a second of said connectors has a separator at its front end that is positioned to deflect said front end portions of said sensing contacts apart as said connectors mate;

each of said sensing contacts is formed from a piece of sheet metal, and each includes a beam with a free front end that is bent 180° around itself to thereby form a rounded beam tip, said beam having first and second portions which extend oppositely from said 180° bend and which lie facewise adjacent to each other with the distance between them being less than the thickness of said beam at said free front end.

* * * * *